US010370866B1

(12) United States Patent
Sanders

(10) Patent No.: US 10,370,866 B1
(45) Date of Patent: Aug. 6, 2019

(54) ROLLABLE CURTAIN PATIO UMBRELLA

(71) Applicant: Eunice Sanders, Florissant, MO (US)

(72) Inventor: Eunice Sanders, Florissant, MO (US)

( * ) Notice: Subject to any disclaimer, the term of this patent is extended or adjusted under 35 U.S.C. 154(b) by 0 days.

(21) Appl. No.: 16/033,882

(22) Filed: Jul. 12, 2018

(51) Int. Cl.

| | |
|---|---|
| ***E04H 15/28*** | (2006.01) |
| ***A45B 25/18*** | (2006.01) |
| ***E06B 9/52*** | (2006.01) |
| ***E04H 15/64*** | (2006.01) |
| ***A45B 25/00*** | (2006.01) |
| ***A45B 23/00*** | (2006.01) |

(52) U.S. Cl.
CPC ..... *E04H 15/28* (2013.01); *A45B 25/18* (2013.01); *E04H 15/64* (2013.01); *E06B 9/521* (2013.01); *A45B 2023/0012* (2013.01); *A45B 2025/003* (2013.01); *A45B 2200/1063* (2013.01)

(58) Field of Classification Search
CPC ... A45B 25/00; A45B 2025/003; A45B 25/18; A45B 2025/186; A45B 2200/1063; E04H 15/28; E04H 15/54; E06B 9/521
See application file for complete search history.

(56) References Cited

U.S. PATENT DOCUMENTS 591,457 A 10/1897 Davis
2,502,984 A * 4/1950 Parmenter ..... A45B 25/18 135/16
2,546,228 A * 3/1951 Martini ..... A45B 25/00 135/16
2,652,845 A * 9/1953 O'Neill ..... E04H 15/003 135/120.1
3,151,621 A * 10/1964 Jackson ..... A45B 23/00 135/16
4,086,931 A * 5/1978 Hall ..... E04H 15/001 135/118
4,285,354 A * 8/1981 Beavers ..... E04H 15/30 135/120.3
4,449,542 A * 5/1984 McSwain ..... A01M 31/00 135/16
D352,759 S 11/1994 Cantwell
5,664,595 A * 9/1997 Vonderhorst ..... A45B 3/00 135/15.1
5,678,587 A 10/1997 Bilotti
(Continued)

FOREIGN PATENT DOCUMENTS

NL 1004754 C1 * 6/1998 ..... A45B 25/18
WO WO9850650 11/1998

*Primary Examiner* — David R Dunn
*Assistant Examiner* — Danielle Jackson

(57) ABSTRACT

A rollable curtain patio umbrella for creating a shaded, netted, and private area includes an umbrella assembly comprising a pole, a support structure and a canopy. The canopy is coupled to the support structure, which is coupled to the pole. The canopy has an outside surface, an inside surface, a front perimeter, a rear perimeter, a right perimeter, and a left perimeter. A plurality of rollable shade curtains is coupled to the umbrella assembly, each shade curtain having a top edge coupled to the outside surface proximal the front perimeter, the rear perimeter, the right perimeter, and the left perimeter, respectively. Each of the shade curtains has a stored position and an alternate deployed position. Each shade curtain in the stored position is rolled adjacent the outside surface of the canopy, while in the alternate deployed position each shade curtain extends from the canopy to the ground.

4 Claims, 5 Drawing Sheets

(56) References Cited

U.S. PATENT DOCUMENTS

| | | | | |
|---|---|---|---|---|
| 5,740,822 | A * | 4/1998 | Einck | A45B 23/00 135/16 |
| 5,806,547 | A * | 9/1998 | Derlinga | A45B 23/00 135/117 |
| 6,017,188 | A * | 1/2000 | Benton | A45B 3/00 248/519 |
| 6,698,440 | B2 | 3/2004 | Beyer et al. | |
| 8,069,871 | B2 * | 12/2011 | Schneider | A47J 36/06 126/201 |
| 8,079,378 | B1 * | 12/2011 | Derlinga | A45B 23/00 135/16 |
| 9,057,206 | B2 * | 6/2015 | Lin | E04H 15/28 |
| 9,388,600 | B2 * | 7/2016 | Leathers | E04H 15/02 |
| 9,603,423 | B1 * | 3/2017 | Skobeleva | A45B 25/18 |
| 2004/0221882 | A1 | 11/2004 | Watson | |
| 2006/0011521 | A1 | 1/2006 | Wu | |
| 2009/0283120 | A1 * | 11/2009 | Varga | A45B 15/00 135/16 |
| 2012/0006370 | A1 | 1/2012 | Liljekvist | |
| 2017/0112244 | A1 * | 4/2017 | Viscogliosi, Jr. | A45B 25/02 |
| 2018/0140060 | A1 * | 5/2018 | Ferrara | A45B 15/00 |
| 2018/0153270 | A1 * | 6/2018 | Khan | A45B 25/18 |

* cited by examiner

ROLLABLE CURTAIN PATIO UMBRELLA

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to patio umbrellas and more particularly pertains to a new patio umbrella for creating a fully shaded, netted, and private area.

BRIEF SUMMARY OF THE INVENTION

An embodiment of the disclosure meets the needs presented above by generally comprising an umbrella assembly, the umbrella assembly comprising a pole, a support structure and a canopy. The canopy is coupled to the support structure, and the support structure is coupled to a top end of the pole. The canopy has an outside surface, an inside surface, a front perimeter, a rear perimeter, a right perimeter, and a left perimeter. A plurality of rollable shade curtains is coupled to the umbrella assembly, the plurality of shade curtains comprising a front shade curtain, a rear shade curtain, a right shade curtain, and a left shade curtain, each having a top edge coupled to the outside surface of the canopy proximal the front perimeter, the rear perimeter, the right perimeter, and the left perimeter, respectively. Each of the plurality of shade curtains has a stored position and an alternate deployed position. Each shade curtain in the stored position is rolled tightly adjacent the outside surface of the canopy, while in the alternate deployed position each shade curtain extends from the canopy to the ground.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
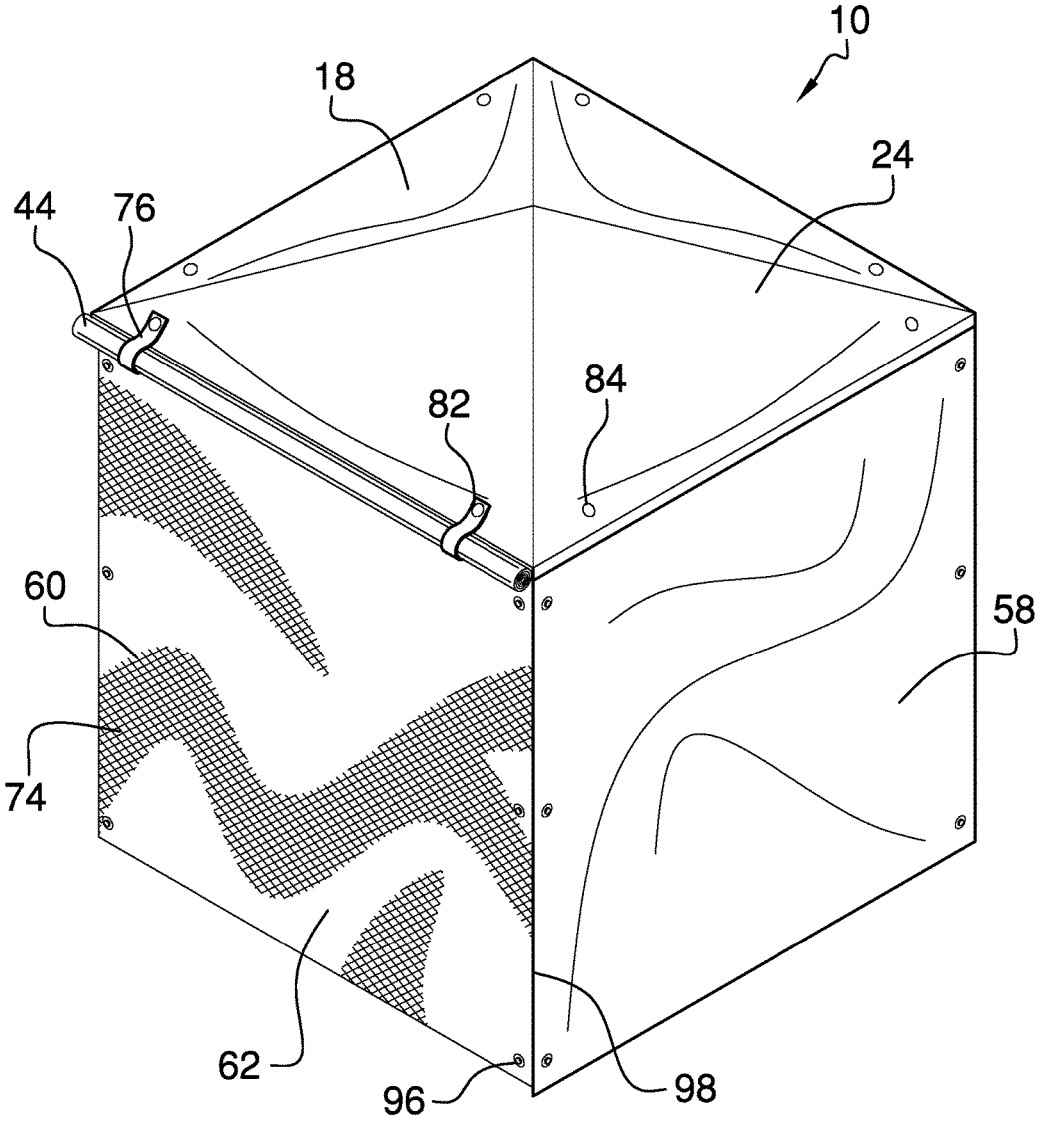
FIG. 1 is an isometric view of a rollable curtain patio umbrella according to an embodiment of the disclosure.
Figure 2:
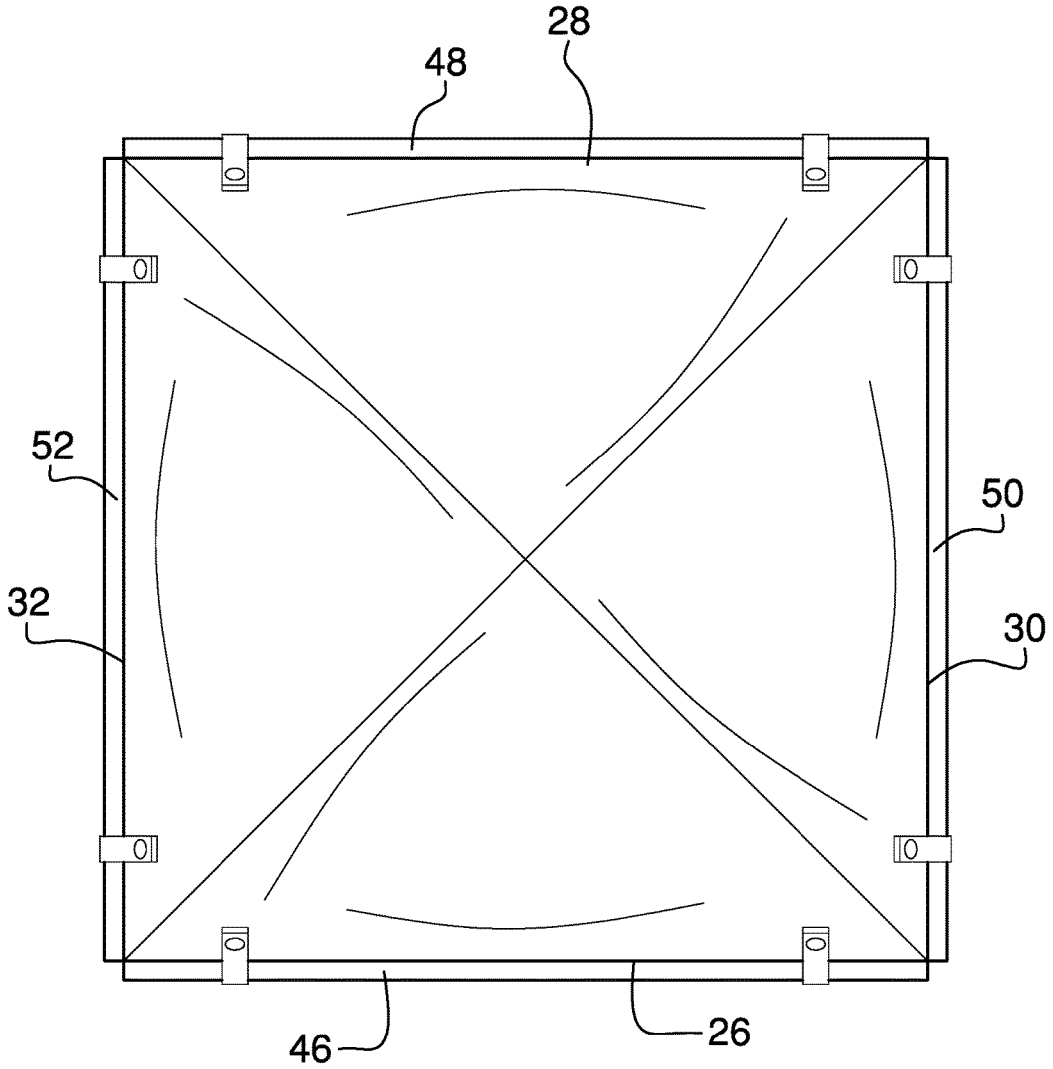
FIG. 2 is a top plan view of an embodiment of the disclosure.
Figure 3:
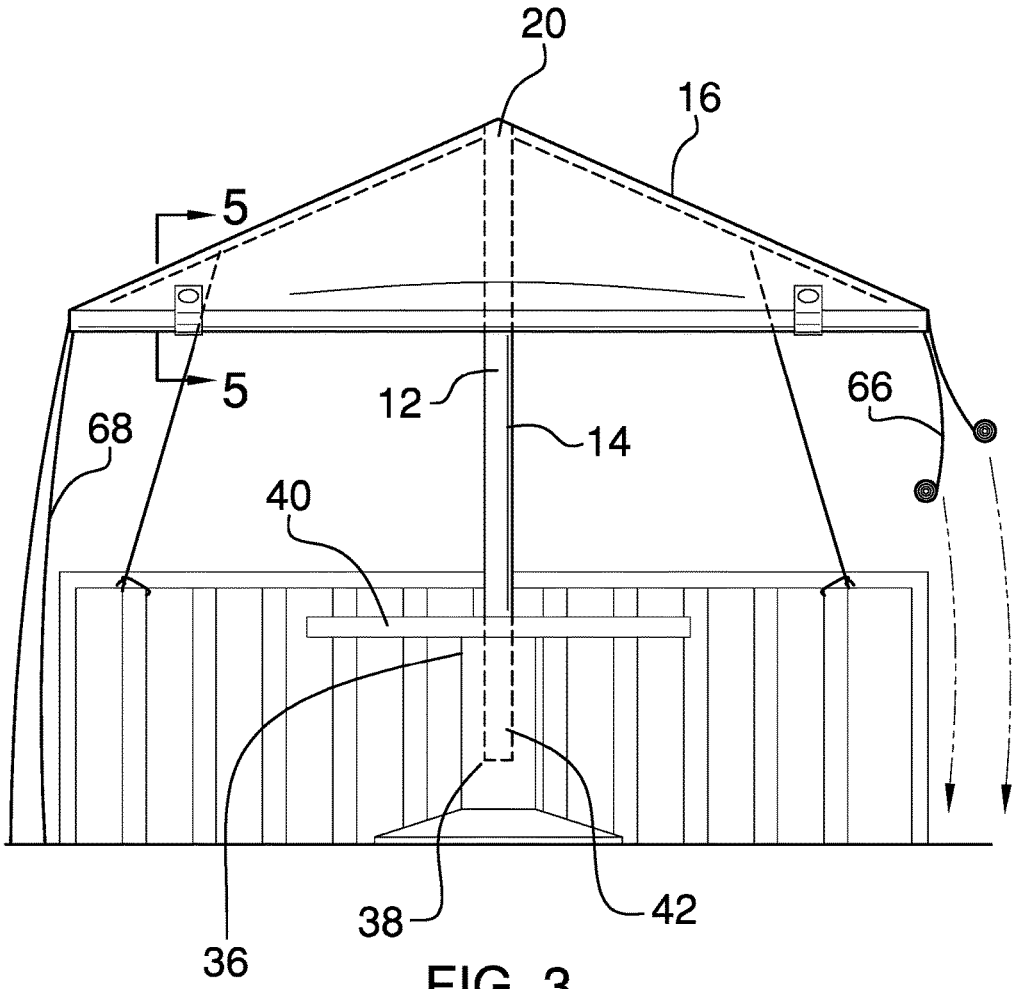
FIG. 3 is a side elevation view of an embodiment of the disclosure.
Figure 4:
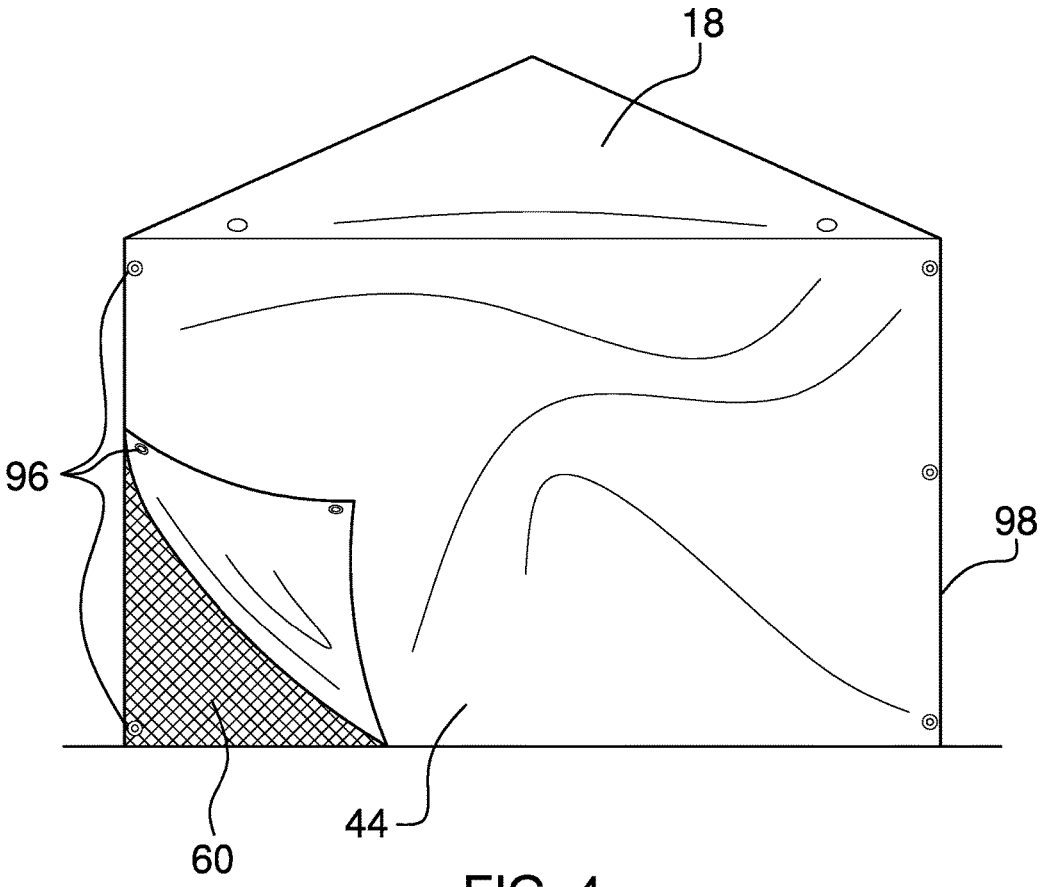
FIG. 4 is an alternative side elevation view of an embodiment of the disclosure.
Figure 5:
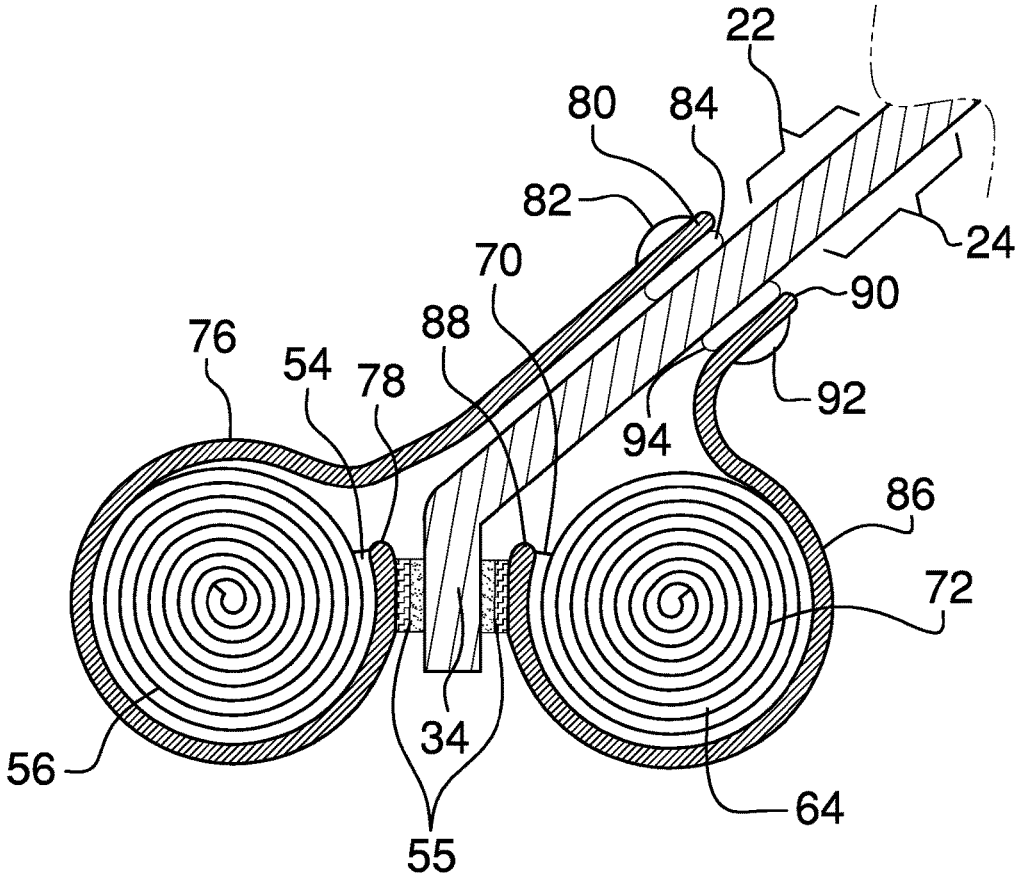
FIG. 5 is a cross-sectional view of an embodiment of the disclosure along line 5-5 of FIG. 3.

With reference now to the drawings, and in particular to FIGS. 1 through 5 thereof, a new patio umbrella embodying the principles and concepts of an embodiment of the disclosure and generally designated by the reference numeral 10 will be described.

As best illustrated in FIGS. 1 through 5, the rollable curtain patio umbrella 10 generally comprises an umbrella assembly 12 comprising a pole 14, a support structure 16 and a canopy 18. The canopy is coupled to the support structure, and the support structure is coupled to a top end 20 of the pole. The canopy 18 has an outside surface 22, an inside surface 24, a front perimeter 26, a rear perimeter 28, a right perimeter 30, and a left perimeter 32. Each of the front perimeter, the rear perimeter, the right perimeter, and the left perimeter of the canopy may have a vertical lip 34. A table 36 may be coupled to the umbrella assembly 12 to provide support. The table has a base 38 and a table top 40 coupled to said base. A central pole aperture 42 extends through the table top 40 and into the base 38, and the pole aperture selectively receives and secures the pole 14 of the umbrella assembly.

A plurality of rollable shade curtains 44 is coupled to the umbrella assembly 12. The plurality of shade curtains comprises a front shade curtain 46, a rear shade curtain 48, a right shade curtain 50, and a left shade curtain 52, each of which has a top edge 54 removably coupled to the outside surface 22 of the canopy on the vertical lip 34 of the front perimeter 26, the rear perimeter 28, the right perimeter 30, and the left perimeter 32, respectively. The top edge 54 may have a hook-and-loop fastener 55 to allow the shade curtain to be removed from the canopy for storage, cleaning, repair, or replacement. Each of the plurality of shade curtains 44 has a stored position 56, in which it is rolled tightly adjacent the outside surface 22 of the canopy, and an alternate deployed position 58, in which it extends from the canopy 18 to the ground. Each of the plurality of rollable shade curtains in the deployed position provides for full shade and privacy from any direction.

A plurality of rollable net curtains 60 may also be coupled to the umbrella assembly 12. The plurality of net curtains comprises a front net curtain 62, a rear net curtain 64, a right net curtain 66, and a left net curtain 68, each of which has an upper edge 70 removably coupled to the inside surface 24 of the canopy on the vertical lip 34 of the front perimeter 26, the rear perimeter 28, the right perimeter 30, and the left perimeter 32, respectively. The upper edge may also have the hook-and-loop fastener 55 to allow the net curtain to be removed from the canopy for storage, cleaning, repair, or replacement. Each of the plurality of net curtains 60 has a rolled position 72, in which it is rolled tightly adjacent the inside surface 24 of the canopy, and an alternate extended position 74, in which it extends from the canopy to the ground. Each of the plurality of rollable net curtains in the extended position provides for partial shade in any direction and, when all net curtains are extended, for protection from insects. Each of the plurality of shade curtains and each of the plurality of net curtains may be in the stored/rolled position or the deployed/extended position independently of the position of any other shade curtain or net curtain.

A plurality of shade fastener straps 76 may be coupled to the plurality of shade curtains 44. Each of the plurality of shade fastener straps has a first fixed end 78 coupled between the top edge 54 and the canopy 18 and a first free end 80 having a first attachment mechanism 82. A plurality of shade strap attachment mechanisms 84 is coupled to the outside surface 22 of the canopy proximal each of the front perimeter 26, the rear perimeter 28, the left perimeter 32, and the right perimeter 30 to selectively receive the first attachment mechanism 82 of the plurality of shade fastener straps, thus maintaining the plurality of shade curtains in the stored position 56. A plurality of net fastener straps 86 may be coupled to the plurality of net curtains 60. Each of the plurality of net fastener straps has a second fixed end 88 coupled between the upper edge 70 and the canopy and a second free end 90 having a second attachment mechanism 92. A plurality of net strap attachment mechanisms 94 is coupled to the inside surface 24 of the canopy proximal each of the front perimeter 26, the rear perimeter 28, the left perimeter 32, and the right perimeter 30 to selectively receive the second attachment mechanism 92 of the plurality of net fastener straps, thus maintaining the plurality of net curtains in the rolled position 72.

There may be a plurality of double-headed joining snaps 96 coupled to each of the plurality of shade curtains 44 and the plurality of net curtains 60. Each of the double-headed joining snaps is coupled proximal a vertical edge 98 of each of the plurality of shade curtains and each of the plurality of net curtains. Each of the plurality of double-headed joining snaps is selectively engageable with one another, thus selectively coupling a first shade curtain of the plurality of shade curtains with an adjacent shade curtain of the plurality of shade curtains, and selectively coupling a first net curtain of the plurality of net curtains with an adjacent net curtain of the plurality of net curtains.

In use, the umbrella assembly 12 is mounted in the table 36 or another umbrella base for support. Depending on the desired amount of exposure, either to light or line of sight from neighbors, a user may unroll any number of shade curtains or net curtains by disconnecting the first free end 80 of the shade fastener strap and the second free end 90 of the net fastener strap, allowing the shade curtains to enter the deployed position 58 and the net curtains to enter the extended position 74. The user may employ the plurality of double-headed joining snaps 94 to secure the vertical edges 94 of adjacent net curtains to form a fully enclosed, insect free environment. The user may also employ the plurality of double-headed joining snaps to secure the vertical edges of adjacent shade curtains to improve stability and minimize flapping in windy environments. As the user's needs change, she may roll the shade curtains back to the stored position 56 and engage the first attachment mechanism 82 of the shade fastener straps to the shade strap attachment mechanisms 84 on the canopy. To create shade only from above as with a traditional umbrella, the user may then roll the net curtains back to the rolled position 72 and engage the second attachment mechanism 92 of the net fastener straps to the net strap attachment mechanisms 94 on the canopy.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A rollable curtain patio umbrella comprising:

an umbrella assembly, the umbrella assembly comprising a pole, a support structure and a canopy, the canopy being coupled to the support structure, and the support structure being coupled to a top end of the pole, the canopy having an outside surface, an inside surface, a front perimeter, a rear perimeter, a right perimeter, and a left perimeter; and a plurality of rollable shade curtains coupled to the umbrella assembly, the plurality of shade curtains comprising a front shade curtain, a rear shade curtain, a right shade curtain, and a left shade curtain, each of the front shade curtain, the rear shade curtain, the right shade curtain, and the left shade curtain having a top edge coupled to the outside surface of the canopy proximal the front perimeter, the rear perimeter, the right perimeter, and the left perimeter, respectively, each of the plurality of shade curtains having a stored position and an alternate deployed position, the plurality of shade curtains in the stored position being rolled tightly adjacent the outside surface of the canopy, the plurality of shade curtains in the alternate deployed position extending from the canopy to the ground;

a plurality of rollable net curtains coupled to the umbrella assembly, the plurality of net curtains comprising a front net curtain, a rear net curtain, a right net curtain, and a left net curtain, each of the front net curtain, the rear net curtain, the right net curtain, and the left net curtain having an upper edge coupled to the inside surface of the canopy proximal the front perimeter, the rear perimeter, the right perimeter, and the left perimeter, respectively, each of the plurality of net curtains having a rolled position and an alternate extended position, the plurality of net curtains in the rolled position being rolled tightly adjacent the inside surface of the canopy, the plurality of net curtains in the alternate extended position extending from the canopy to the ground;

a table having a base and a table top coupled to said base, the table having a central pole aperture extending through the table top and into the base, the central pole aperture selectively receiving and securing the pole of the umbrella assembly;

a plurality of shade fastener straps coupled to the plurality of shade curtains, each of the plurality of shade fastener straps having a first fixed end and a first free end, the first fixed end being coupled between the top edge and the canopy, the first free end having a first attachment mechanism;

a plurality of shade strap attachment mechanisms coupled to the umbrella assembly, each of the plurality of shade strap attachment mechanisms being coupled to the outside surface of the canopy proximal each of the front perimeter, the rear perimeter, the left perimeter, and the right perimeter, the plurality of shade strap attachment mechanisms selectively receiving the first attachment mechanism of the plurality of shade fastener straps to maintain the plurality of shade curtains in the stored position;

a plurality of net fastener straps coupled to the plurality of net curtains, each of the plurality of fastener straps having a second fixed end and a second free end, the second fixed end being coupled between the upper edge and the canopy, the second free end having a second attachment mechanism;

a plurality of net strap attachment mechanisms coupled to the umbrella assembly, each of the plurality of net strap attachment mechanisms being coupled to the inside surface of the canopy proximal each of the front perimeter, the rear perimeter, the left perimeter, and the right perimeter, the plurality of net strap attachment mechanisms selectively receiving the second attachment mechanism of the plurality of net fastener straps to maintain the plurality of net curtains in the rolled position; and a plurality of double-headed joining snaps coupled to each of the plurality of shade curtains and the plurality of net curtains, each of the double-headed joining snaps being coupled proximal a vertical edge of each of the plurality of shade curtains and each of the plurality of net curtains, each of the plurality of double-headed joining snaps being selectively engageable with one another, the plurality of double-headed joining snaps selectively coupling a first shade curtain of the plurality of shade curtains with an adjacent shade curtain of the plurality of shade curtains, and the plurality of double-headed joining snaps selectively coupling a first net curtain of the plurality of net curtains with an adjacent net curtain of the plurality of net curtains.

2. The rollable curtain patio umbrella of claim 1, further comprising each of the front perimeter, the rear perimeter, the right perimeter, and the left perimeter of the canopy having a vertical lip, each of the plurality of shade curtains and each of the plurality of net curtains being coupled to the vertical lip.

3. The rollable curtain patio umbrella of claim 2, further comprising each of the plurality of shade curtains having a hook-and-loop fastener coupled between the shade fastener strap and the vertical lip and each of the plurality of net curtains having a hook-and-loop fastener coupled between the net fastener strap and the vertical lip, each of the plurality of shade curtains and each of the plurality of net curtains thus being selectively removable from the canopy.

4. A rollable curtain patio umbrella comprising:

an umbrella assembly, the umbrella assembly comprising a pole, a support structure and a canopy, the canopy being coupled to the support structure, and the support structure being coupled to a top end of the pole, the canopy having an outside surface, an inside surface, a front perimeter, a rear perimeter, a right perimeter, and a left perimeter, each of the front perimeter, the rear perimeter, the right perimeter, and the left perimeter of the canopy having a vertical lip;

a table coupled to the umbrella assembly, the table having a base and a table top coupled to said base, the table having a central pole aperture extending through the table top and into the base, the central pole aperture selectively receiving and securing the pole of the umbrella assembly;

a plurality of rollable shade curtains coupled to the umbrella assembly, the plurality of shade curtains comprising a front shade curtain, a rear shade curtain, a right shade curtain, and a left shade curtain, each of the front shade curtain, the rear shade curtain, the right shade curtain, and the left shade curtain having a top edge removably coupled to the outside surface of the canopy on the vertical lip of the front perimeter, the rear perimeter, the right perimeter, and the left perimeter, respectively, the top edge having a hook-and-loop fastener, each of the plurality of shade curtains having a stored position and an alternate deployed position, the plurality of shade curtains in the stored position being rolled tightly adjacent the outside surface of the canopy, the plurality of shade curtains in the alternate deployed position extending from the canopy to the ground;

a plurality of rollable net curtains coupled to the umbrella assembly, the plurality of net curtains comprising a front net curtain, a rear net curtain, a right net curtain, and a left net curtain, each of the front net curtain, the rear net curtain, the right net curtain, and the left net curtain having an upper edge removably coupled to the inside surface of the canopy on the vertical lip of the front perimeter, the rear perimeter, the right perimeter, and the left perimeter, respectively, the upper edge having a hook-and-loop fastener, each of the plurality of net curtains having a rolled position and an alternate extended position, the plurality of net curtains in the rolled position being rolled tightly adjacent the inside surface of the canopy, the plurality of net curtains in the alternate extended position extending from the canopy to the ground;

a plurality of shade fastener straps coupled to the plurality of shade curtains, each of the plurality of shade fastener straps having a first fixed end and a first free end, the first fixed end being coupled between the top edge and the canopy, the first free end having a first attachment mechanism;

a plurality of shade strap attachment mechanisms coupled to the umbrella assembly, each of the plurality of shade strap attachment mechanisms being coupled to the outside surface of the canopy proximal each of the front perimeter, the rear perimeter, the left perimeter, and the right perimeter, the plurality of shade strap attachment mechanisms selectively receiving the first attachment mechanism of the plurality of shade fastener straps to maintain the plurality of shade curtains in the stored position;

a plurality of net fastener straps coupled to the plurality of net curtains, each of the plurality of fastener straps having a second fixed end and a second free end, the second fixed end being coupled between the upper edge and the canopy, the second free end having a second attachment mechanism;

a plurality of net strap attachment mechanisms coupled to the umbrella assembly, each of the plurality of net strap attachment mechanisms being coupled to the inside surface of the canopy proximal each of the front perimeter, the rear perimeter, the left perimeter, and the right perimeter, the plurality of net strap attachment mechanisms selectively receiving the second attachment mechanism of the plurality of net fastener straps to maintain the plurality of net curtains in the rolled position; and a plurality of double-headed joining snaps coupled to each of the plurality of shade curtains and the plurality of net curtains, each of the double-headed joining snaps being coupled proximal a vertical edge of each of the plurality of shade curtains and each of the plurality of net curtains, each of the plurality of double-headed joining snaps being selectively engageable with one another, the plurality of double-headed joining snaps selectively coupling a first shade curtain of the plurality of shade curtains with an adjacent shade curtain of the plurality of shade curtains, and the plurality of double-headed joining snaps selectively coupling a first net curtain of the plurality of net curtains with an adjacent net curtain of the plurality of net curtains.

* * * * *